US008149199B2

(12) United States Patent
Tsai et al.

(10) Patent No.: US 8,149,199 B2
(45) Date of Patent: Apr. 3, 2012

(54) DRIVING SYSTEM AND METHOD FOR LIQUID CRYSTAL DISPLAY

(75) Inventors: Pei-Ting Tsai, Taitung (TW); Wen Min Lu, Hsin Chu (TW)

(73) Assignee: Etron Technology, Inc., Hsin-Chu (TW)

( * ) Notice: Subject to any disclaimer, the term of this patent is extended or adjusted under 35 U.S.C. 154(b) by 890 days.

(21) Appl. No.: 12/047,809

(22) Filed: Mar. 13, 2008

(65) Prior Publication Data

US 2009/0015531 A1 Jan. 15, 2009

(30) Foreign Application Priority Data

Jul. 12, 2007 (TW) ..... 96125384 A

(51) Int. Cl.
*G09G 3/36* (2006.01)

(52) U.S. Cl. ..... 345/89; 345/204; 345/87; 345/94; 345/98

(58) Field of Classification Search ..... 345/204, 345/87, 89, 94, 98
See application file for complete search history.

(56) References Cited

U.S. PATENT DOCUMENTS 6,778,157 B2 * 8/2004 Aoki ..... 345/87
7,148,868 B2 * 12/2006 Lee ..... 345/87

* cited by examiner

*Primary Examiner* — Bipin Shalwala
*Assistant Examiner* — Ilana Spar
(74) *Attorney, Agent, or Firm* — Muncy, Geissler, Olds & Lowe, PLLC

(57) ABSTRACT

A driving system and method for liquid crystal display is disclosed. The system stores only the driving values corresponding to specific grayscale values of pixels on a current frame and specific grayscale values of pixels on a previous frame. The stored driving values are then used by an operation processing unit of the system to calculate out driving values to be applied to the current frame. Moreover, the system is provided with a logic judging unit for preventing the noises of the frame from being overdriven.

16 Claims, 6 Drawing Sheets

DRIVING SYSTEM AND METHOD FOR LIQUID CRYSTAL DISPLAY

This application claims priority of Application No. 096125384 filed in Taiwan R.O.C on Jul. 12, 2007, under 35 U.S.C. §119; the entire contents of all of which are hereby incorporated by reference.

BACKGROUND OF THE INVENTION

1. Field of the Invention

The invention relates to a liquid crystal display and, more particularly, to an image driving system of a liquid crystal display and method for the same.

2. Brief Description of the Related Art

A liquid crystal display (LCD) displays images by applying fluctuating electric field to the liquid crystal to orientate the liquid crystal molecules and thus to modulate the light transmission through the liquid crystal. However, the orientation of the liquid crystal molecules does not simultaneously change with a change of an electric field. Thus, the response speed for displaying an image by a LCD is always lower than that by a typical cathode ray tube (CRT). This causes a serious delay problem when dynamic video images are displayed.

In view of this, a high speed image driving scheme is used to drive a liquid crystal display. The scheme applying higher voltages to each pixel can speed up the response of the liquid crystal molecules, such that the liquid crystal molecules can tilt to preset directions in a frame period.

FIG. 1 is a timing chart schematically shows difference in responses to an applied pixel voltage under an ordinary scheme and a high speed scheme. The horizontal axis represents time, and the vertical axis represents the pixel voltage. Under an ordinary scheme, during a frame period T, the pixel voltage, designated as numeral 1, is changed from V1 to V2, and the transmittance of the pixel that changes as a result of the voltage variation is designated as numeral 2. Comparatively, under a high speed driving scheme, during a frame period T, the pixel voltage, designated as numeral 1', is changed from $V_1$ to $V_2'$, and the transmittance of the pixel that changes as a result of the voltage variation is designated as numeral 2'. Obviously, the response time based on a high speed scheme is shorter.

The high speed image driving scheme of a liquid crystal display can refer to a U.S. Pat. No. 5,495,265. As shown in FIG. 2, a typical high speed image driving system 10 for a liquid crystal display reads and compares pixel data of a current frame $G_n$ and a previous frame $G_{n-1}$, and uses a look-up table to obtain driving values according to the result of the comparisons, and applies the driving values to the pixels to generate a corrected frame $G_{n'}$. Apparently, the high speed image driving system 10 needs two memories, one of which is a frame buffer 101 and the other is a mapping table 102.

The frame buffer 101 is used for storing pixel data of a current frame $G_n$, and outputting pixel data of a previous frame $G_{n-1}$. The mapping table 102 is used for storing driving values in correspondence with grayscale values of each pixel datum. Specifically, the mapping table 102 is in a matrix form that records driving values in correspondence with grayscale values of pixel data of the current frame and the previous frame. Typically, the buffer 101 needs to have a capacity capable of storing 24, i.e. 3×8, bits of grayscale values for each RGB pixel data, and the mapping table 102 needs to have a capacity capable of storing 3×28×28 numbers of high speed driving values for each RGB pixel data.

In this way, the high speed driving scheme is heavily loaded with the high cost memory of a liquid crystal display.

Furthermore, the high speed driving scheme also causes amplification of the noises on displaying images, and badly influences image quality.

SUMMARY OF THE INVENTION

In view of the above problems, the present invention proposed a driving system for a liquid crystal display, which effectively compensates the response of liquid crystals in display with the needed capacity of memories being minimized, and thus eliminates bad effect caused by image noises.

The driving system for a liquid crystal display according to the invention comprises a first memory, a second memory, a third memory, an operation processing unit and a logic judging unit. It is known that sensitivity of a naked eye to high speed dynamic image would decline, and which becomes a basis of the proposed driving system. The first memory is used to store pixel data of a current frame. The second and the third memory are used to store specific grayscale values of the pixel data of the current frame and the previous frame, respectively. The operation processing unit is used to perform an interpolation operation to obtain driving values corresponding to grayscale values of pixel data of the current frame and grayscale values of pixel data of the previous frame. Moreover, a logic judging unit is added to prevent image noises from being over amplified.

In one embodiment of the invention, the first memory of the invention is used to store pixel data of a current frame and output pixel data of a previous frame. Each pixel datum includes a plurality of c-bit grayscale values, where "c" is a positive integer. Therefore, the first memory stores c-bit grayscale values of pixel data of the current frame, and outputs the most significant "A" bits of grayscale values from the c-bit grayscale values of pixel data of the previous frame, where "A" is a positive integer less than "c". On the other hand, the second memory of the invention stores driving values corresponding to half part of the most significant "A" bits of grayscale values from the c-bit grayscale values of pixel data of the current frame and the most significant "A" bits of grayscale values from the c-bit grayscale values of pixel data of the previous frame. Further, the third memory of the invention stores driving values corresponding to another half part of the most significant "A" bits of grayscale values from the c-bit grayscale values of pixel data of the current frame and the most significant "A" bits of grayscale values from the c-bit grayscale values of pixel data of the previous frame.

At first, the operation processing unit of the invention reads the least significant "B" bits of grayscale values W from the c-bit grayscale values of a pixel data of the current frame, a first driving value X stored in the second memory, and a second driving value Y stored in the third memory, where "B" is a positive integer. Then, the operation processing unit performs an interpolation operation to obtain a third driving value Z, where value Z is between X and Y. The logic judging unit of the invention reads pixel data of the current frame and the pixel data of the previous frame, and judges if a difference of the c-bit grayscale values of the pixel data of the current frame and of the pixel frame is less than a specific value.

The driving system of the invention is advantageous in low cost by having memories of less capacity and better display image due to remove of image noises.

DETAILED DESCRIPTION OF THE INVENTION

An image driving system and method for a liquid crystal display according to the invention are described as follows. The conceptual aspects of the image driving system and method are explained with concrete embodiments. However, the invention is not limited to these embodiments, and various modifications thereof are considered to be encompassed thereby.

Figure 1:
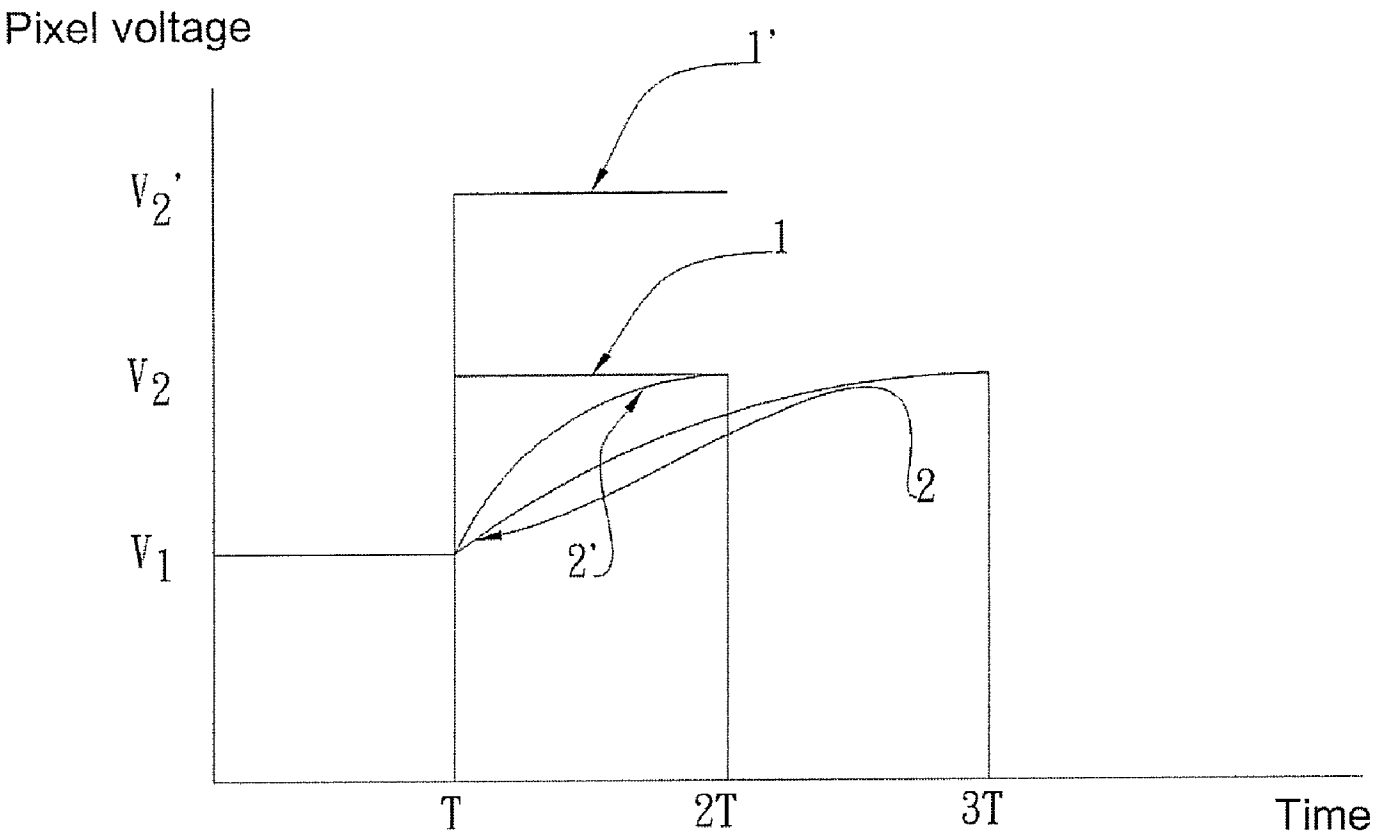
FIG. 1 (Prior Art)
FIG. 1 is a timing chart schematically shows comparison responses to an applied pixel voltage under an ordinary scheme and a high speed scheme, wherein the horizontal axis represents the time and the vertical axis represents the pixel voltage.
Figure 2:
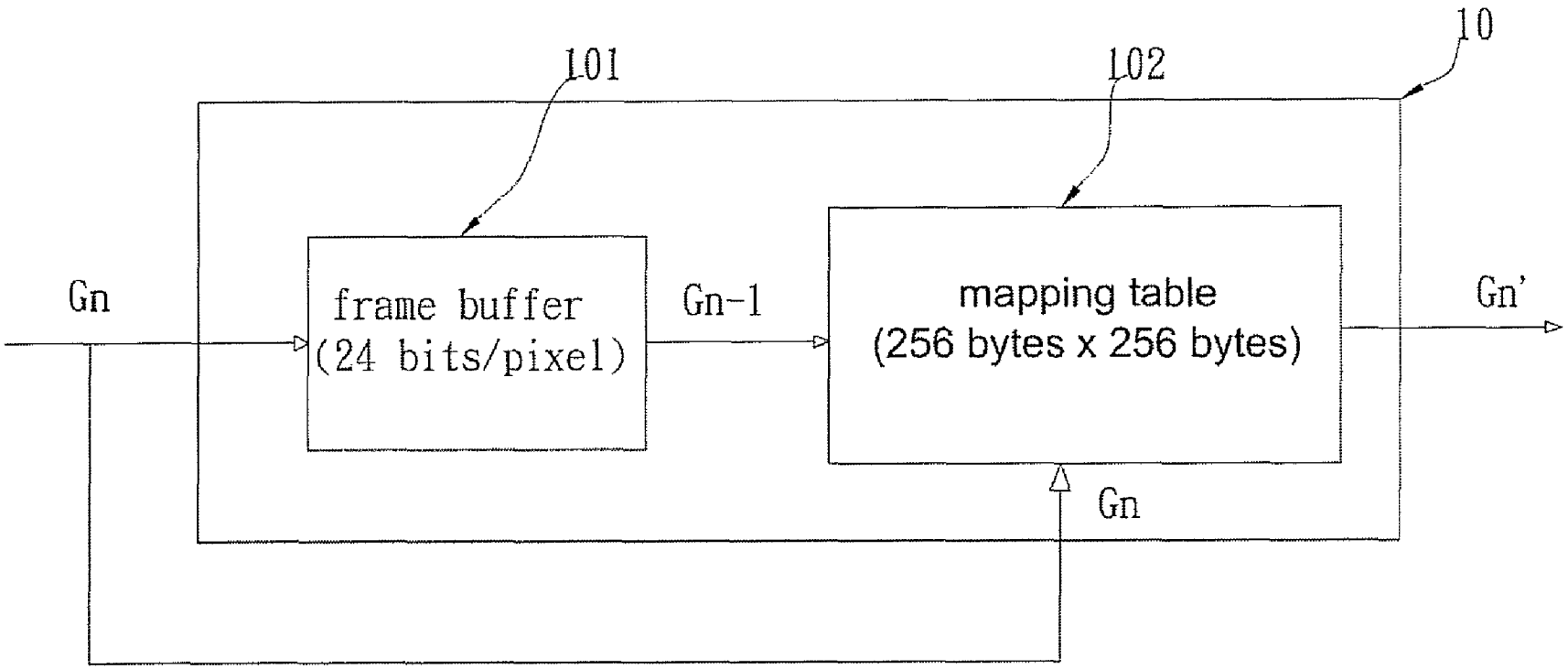
FIG. 2 (Prior Art)
FIG. 2 is a block diagram schematically showing a typical high speed driving scheme of a liquid crystal display.
Figure 3:
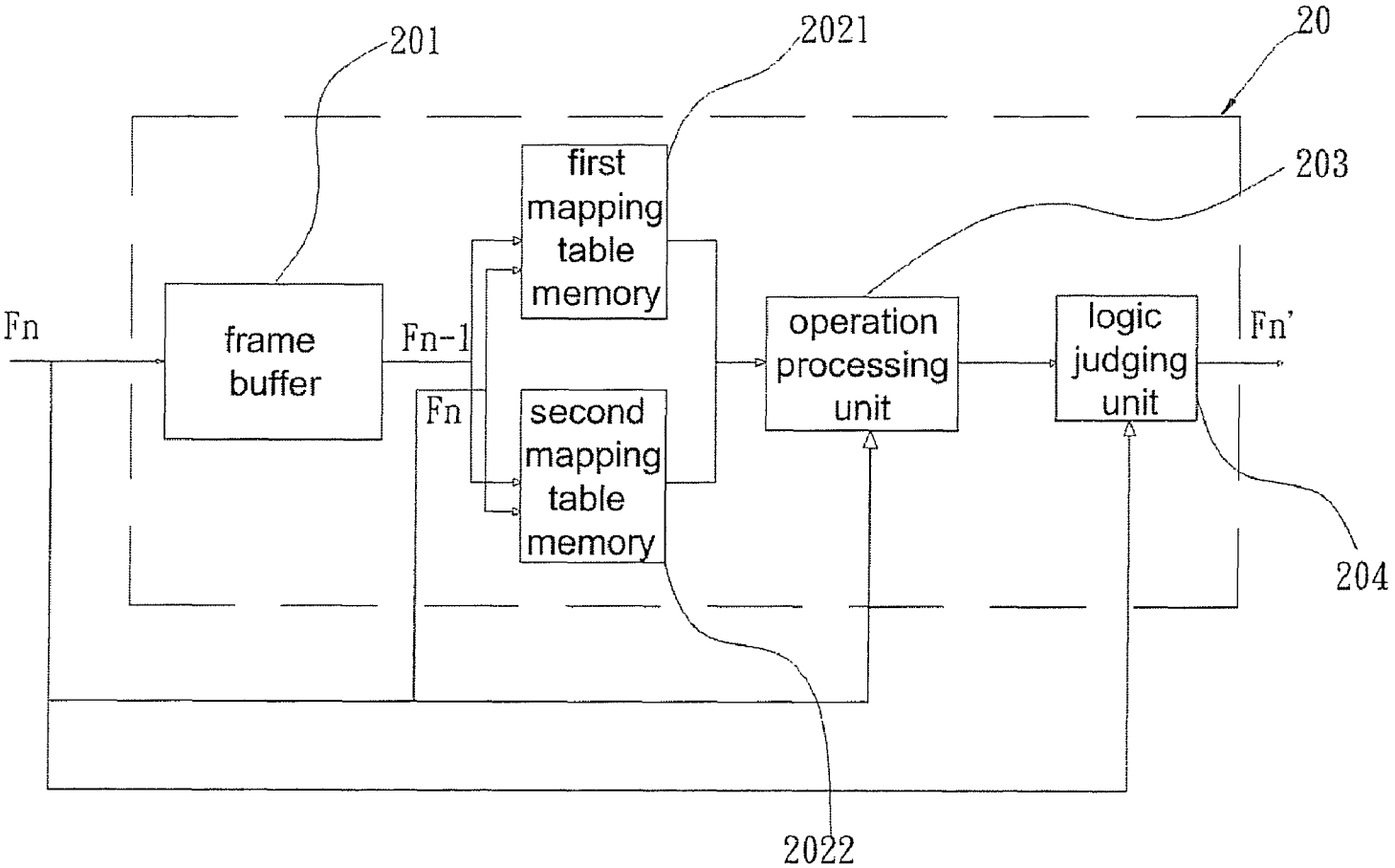
FIG. 3 is a block diagram schematically showing a driving system of a liquid crystal display according to one embodiment of the invention.

Referring to FIG. 3, an image driving system 20 for a liquid crystal display according to one embodiment of the invention includes a frame buffer 201, a first mapping table memory 2021, a second mapping table memory 2022, an operation processing unit 203, and a logic judging unit 204.

The frame buffer 201 is used to receive and temporarily store pixel data of a current frame $F_n$, and to output pixel data of a previous frame $F_{n-1}$. Herein, each pixel datum includes a plurality of c-bit grayscale values, such as 8-bit grayscale values of original R (red), G(green), and B(blue) colors. Of course, "c" can be any positive integer. Specifically, the frame buffer 201 stores the c-bit grayscale values of each pixel datum of the current frame $F_n$, and outputs the most significant "A" bits of the c-bit grayscale values of each pixel datum of the previous frame $F_{n-1}$, wherein "A" is a positive integer less than "c". For example, "c" and "A" are 8 and 5, respectively.

The first mapping table memory 2021 is used to store driving values corresponding to half the most significant "A" bits of grayscale values of any pixel data in the current frame $F_n$, and the most significant "A" bits of grayscale values of the same pixel data of the previous frame $F_{n-1}$. The second mapping table memory 2022 is used to store driving values corresponding to another half the most significant "A" bits of grayscale values of the same pixel data of the current frame $F_n$, and the most significant "A" bits of grayscale values of the same pixel data of the previous frame $F_{n-1}$. In this way, the first mapping table memory 2021 and the second mapping table memory 2022 each stores $2^{(a-1)}\times 2^a$ driving values.

In one embodiment, the first mapping table memory 2021 of the invention stores driving values corresponding to the most significant "A" bits of grayscale values of any pixel data in the current frame $F_n$ that are in odd columns, and the most significant "A" bits of grayscale values of the same pixel data of the previous frame $F_{n-1}$. Meanwhile, the second mapping table memory 2022 stores driving values corresponding to the most significant "A" bits of grayscale values of the same pixel data of the current frame $F_n$ that are in even columns, and the most significant "A" bits of grayscale values of the same pixel data of the previous frame $F_{n-1}$.

The operation processing unit 203 is used to read the least significant "B" bits of grayscale values W of any pixel data of the current frame $F_n$, a first driving value X stored in the first mapping table memory 2021, and a second driving value Y stored in the second mapping table memory 2022, and therefore perform an interpolation calculation to output a third driving value Z between X and Y. In one embodiment, "B" is a positive integer satisfying the equation "B"="c"−"A", and Z satisfies the equation $Z=(1/2^B)\cdot[X\cdot(2^B-W)+Y\cdot W]$. For example, "B" is 3 when "c" and "A" are 8 and 5, respectively.

The logic judging unit 204 is used to read pixel data of the current frame $F_n$ and the pixel data of the previous frame $F_{n-1}$, and determine if a difference of grayscale values of the pixel data of the current frame $F_n$ and the previous frame $F_{n-1}$ is less than a specified value. Generally, a zero or small difference between grayscale values of pixel data of the current frame and previous frame is caused by noises, therefore the driving system 20 would take the driving values corresponding to grayscale values of the pixel data of the current frame as what is required for adjusting the driving voltage for a corrected frame $F_n'$.

Figure 4A:
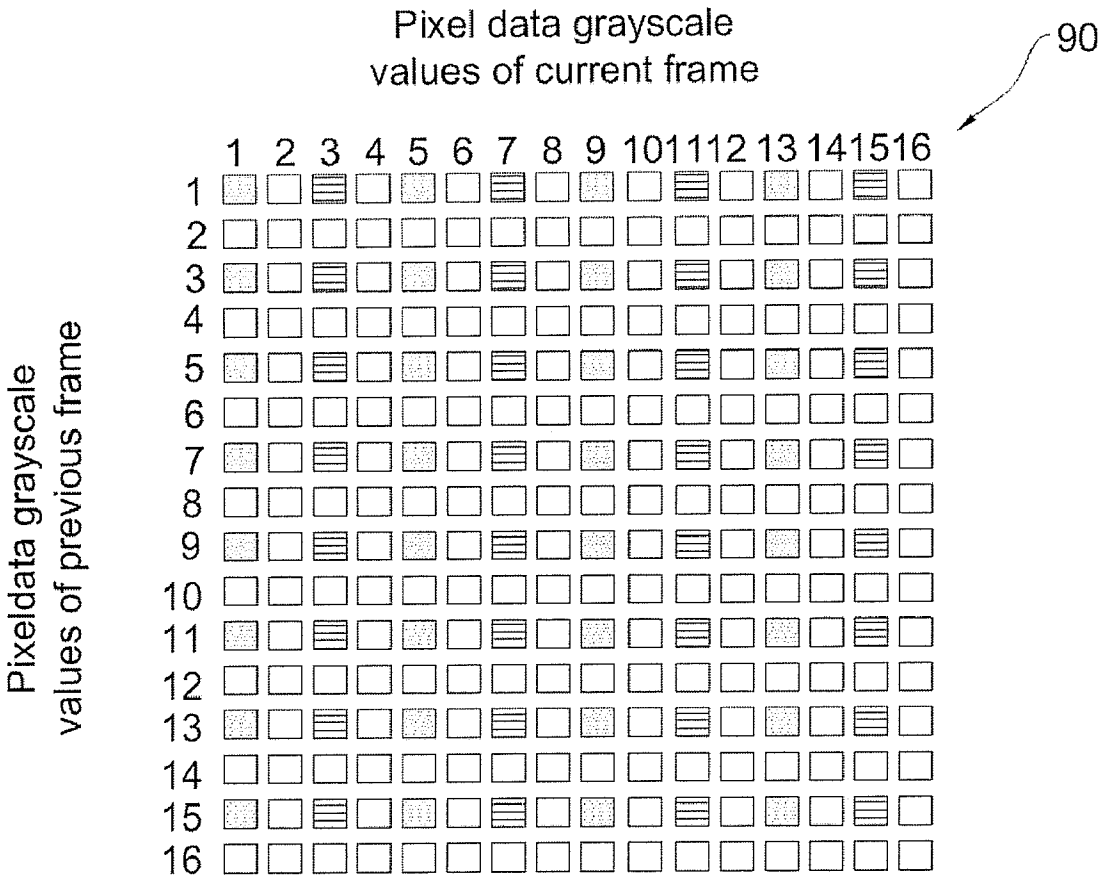
FIG. 4A is a matrix schematically showing driving values that are in correspondence with grayscale values of pixel data from a current frame and a previous frame.
Figure 4B:
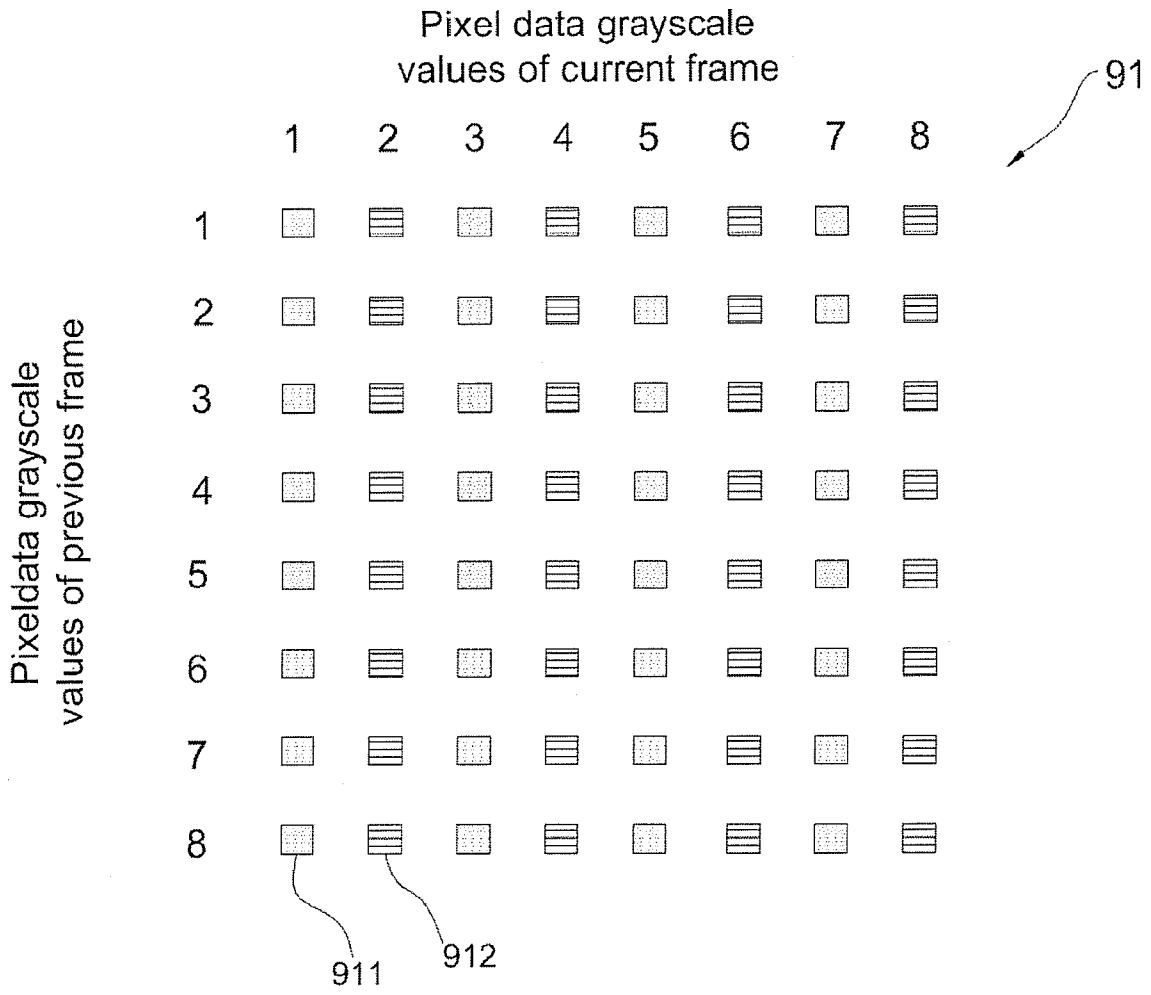
FIG. 4B is a matrix schematically showing driving values that are in correspondence with grayscale values at odd columns of a current frame and odd rows of a previous frame in FIG. 4A.

Referring to FIGS. 4A and 4B, the mapping tables stored in the first mapping table memory 2021 and the second mapping table memory 2022 are in matrix form as shown, respectively. Referring to FIG. 4A, an original mapping table 90 is a $2^4\times 2^4$ matrix, where the transverse shows all 4-bit grayscale values of a pixel data of the current frame, and the vertical shows all 4-bit grayscale values of the same pixel data of the previous frame. Meanwhile, a crossing position of any one grayscale value in the transverse and any one grayscale value in the vertical corresponds to a driving value. Referring to FIG. 4B, the mapping table 91 is formed by selecting only half the grayscale values from the transverse and half the grayscale values from the vertical of the original mapping table 90. In other words, the transverse of the mapping table 91 is a $2^3\times 2^3$ matrix, where the transverse shows the most significant 3 bits of grayscale values of a pixel data of the current frame, and the vertical shows the most significant 3 bits of grayscale values of the same pixel data of the previous frame.

In addition, we can further select driving values that are only corresponds to the odd or even grayscale values of the pixel data of the current frame and the grayscale values of the same pixel data of the previous frame to form an odd or even mapping table.

Therefore, driving values corresponding to an odd portion of grayscale values of the most significant "A" bits of each c-bit pixel data of the current frame $F_n$ and all portion of grayscale values of the same pixel data of the previous frame are similar to that shown by numeral 911 in FIG. 4B. The driving values corresponding to an even portion of grayscale values of the most significant "A" bits of each c-bit pixel data of the current frame $F_n$ and all portion of grayscale values of the same pixel data of the previous frame are similar to that shown by numeral 912 in FIG. 4B.

As shown, we can have a sampling mapping table in matrix including $2^{(c-k)}\times 2^{(c-k)}$ driving values corresponding to pixel data of the current frame and the same pixel data of the previous frame from the original mapping table storing $2^c\times 2^c$ driving values by sampling one from $2^k$. Moreover, the sampling mapping table can be divided into two sub-sampling mapping table such as odd and even mapping tables each recording only $2^{(c-k-1)}\times 2^{(c-k)}$ driving values. For example, when "k" is 3 and "c" is 8, we can have a sampling mapping table of $2^5\times 2^5$ driving values and an odd mapping table and an even mapping table of $2^4\times 2^5$ driving values, respectively.

Therefore, these driving values can be stored in memories with less capacity than ever used.

Figure 5:
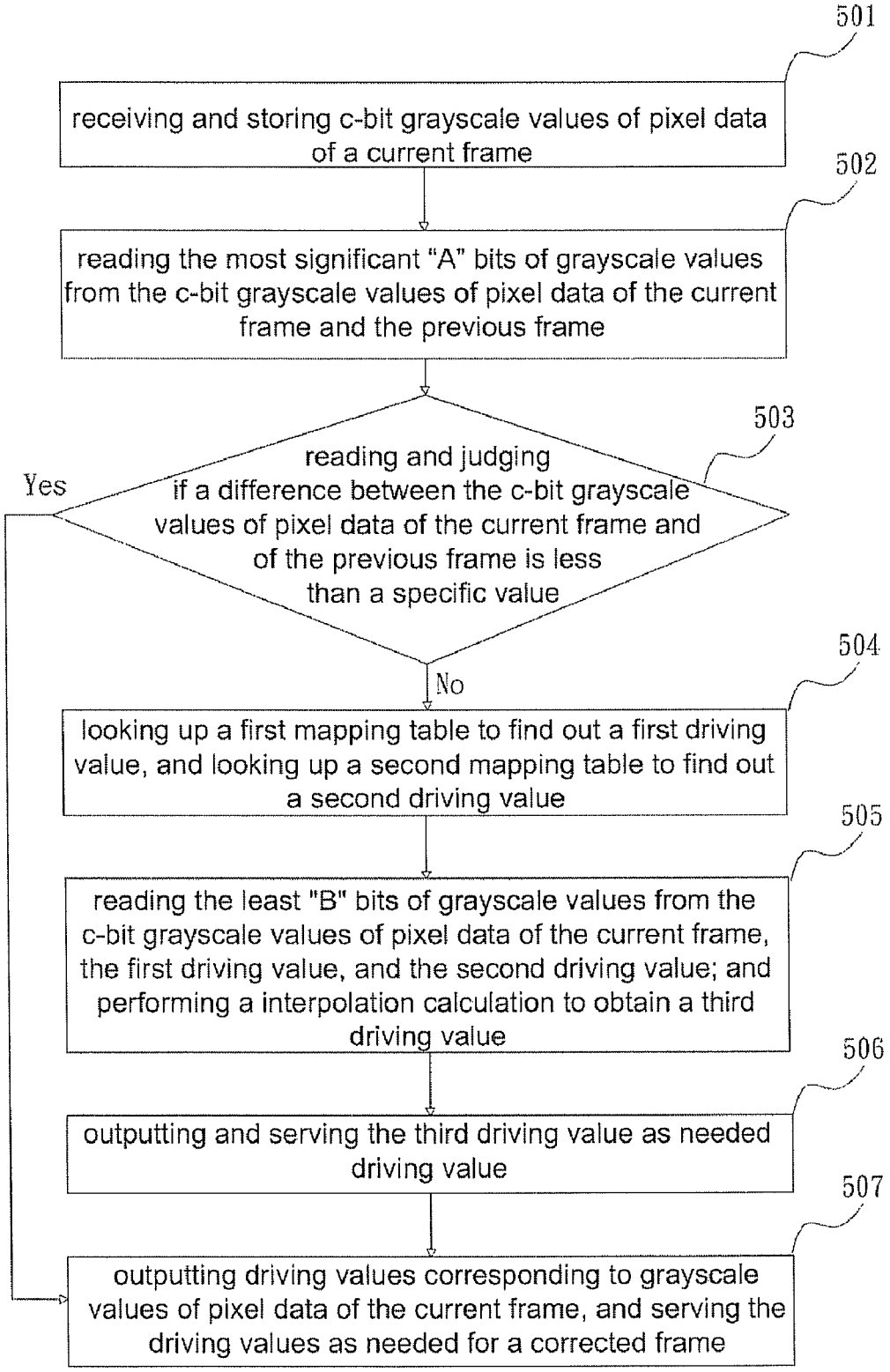
FIG. 5 is a flow chart schematically showing steps for implementing the driving system of a liquid crystal display according to the present invention.

Referring to FIG. 3 and FIG. 5, the driving system 20 of a liquid crystal display according to one embodiment of the invention is implemented by the following steps.

step 501: receiving c-bit grayscale values of pixel data of a current frame F, and storing the grayscale values in a frame buffer 201, wherein "c" is a positive integer.

step 502: reading the most significant "A" bits of grayscale values from the c-bit grayscale values of pixel data of the current frame $F_n$, and of the previous frame $F_{n-1}$, wherein "A" is a positive integer less than "c".

step 503: reading and judging a difference between the c-bit grayscale values of pixel data of the current frame and of the previous frame via a logic judging unit 204; when the difference isn't less than a specific value, then go to step 504, when the difference is less than a specific value, then go to step 507.

step 504: looking up a first mapping table stored in the first mapping table memory 2021 to find out a first driving value X, and looking up a second mapping table stored in the second mapping table memory 2022 to find out a second driving value Y.

step 505: reading the least "B" bits of grayscale values W from the c-bit grayscale values of pixel data of the current frame $F_n$, the first driving value X, and the second driving value Y; and performing a interpolation calculation to obtain a third driving value Z via the operation processing unit 203, wherein Z is between X and Y and satisfies $Z=(1/2^B)\cdot[X\cdot(2^B-W)+Y\cdot W]$.

step 506: outputting and serving the third driving value Z as driving values for adjusting driving voltages for a corrected frame $F_n'$.

step 507: outputting driving values corresponding to grayscale values of pixel data of the current frame, serving as driving values for adjusting the driving voltages for the corrected frame $F_n'$.

In this way, the response of liquid crystal molecules can be speeded up, and the memory capacity of a frame butter unit 201 of the driving system 20 of the liquid crystal display can be saved. The side effect caused by enlarged noises can also be lowered.

It is to be further understood that even though numerous characteristics and advantages of the present embodiments have been set out in the foregoing description, together with details of the structures and functions of the embodiments, the disclosure is illustrative only, and changes may be made in detail, especially in matters of size, and arrangement of parts within the principles of the invention to the full extent indicated by the broad general meaning of the terms during which the appended claims are expressed. For example, the mapping tables in the mapping table memory 2021 and 2022 are not limited to the illustrated odd or even mapping tables, but can be others for affording information to do calculation. The above-mentioned numbers "A", "B", "c", and "k" can also be modified according to demand.

What is claimed is:

1. A driving system for liquid crystal display, comprising:

a first memory for storing pixel data of a current frame and outputting the same pixel data of a previous frame, each pixel datum comprising a plurality of c-bit grayscale values, the first memory storing the c-bit grayscale values of the pixel data of the current frame and outputting the most significant "A" bits of grayscale values from the c-bit grayscale values of the pixel data of the previous frame, wherein "c" and "A" are positive integers and "A" is less than "c";

a second memory for storing driving values corresponding to a first part of the most significant "A" bits of grayscale values from the c-bit grayscale values of the pixel data of the current frame where the first part is smaller than "A", and the most significant "A" bits of grayscale values from the c-bit grayscale values of the pixel data of the previous frame;

a third memory for storing driving values corresponding to a second part of the most significant "A" bits of grayscale values from the c-bit grayscale values of each pixel datum of the current frame where the second part is smaller than "A", and the most significant "A" bits of grayscale values from the c-bit grayscale values of each pixel datum of the previous frame;

an operation processing unit for reading the least significant "B" bits of grayscale values W from the c-bit grayscale values of pixel data of the current frame, a first driving value X stored in the second memory and a second driving value Y stored in the third memory, and processing a calculation to obtain a third driving value Z between X and Y, wherein "B" is a positive integer; and a logic judging unit for reading pixel data of the current frame and the same pixel data of the previous frame, and judging if a difference of the c-bit grayscale values between pixel data of the current frame and the same pixel data of the previous frame is less than a specified value, wherein the third driving value Z is outputted as a driving value for the current frame when the difference is larger than the specified value.

2. The driving system for liquid crystal display as set forth in claim 1, wherein "B" satisfies an equation "B"="c"−"A".

3. The driving system for liquid crystal display as set forth in claim 1, wherein the first part of the most significant "A" bits of grayscale values from the c-bit grayscale values of the pixel data of the current frame is an odd portion, and the second part of the most significant "A" bits of grayscale values from the c-bit grayscale values of the pixel data of the current frame is an even portion.

4. The driving system for liquid crystal display as set forth in claim 1, wherein Z satisfies an equation $Z=(1/2^B)\cdot[X\cdot(2^B-W)+Y\cdot W]$.

5. The driving system for liquid crystal display as set forth in claim 1, wherein each pixel datum comprises grayscale values of R, G and B.

6. The driving system for liquid crystal display as set forth in claim 1, wherein "c" is 8.

7. The driving system for liquid crystal display as set forth in claim 1, wherein "A" is 5 and "B" is 3.

8. A driving system for liquid crystal display, comprising:

a first memory for storing pixel data of a current frame and outputting the same pixel data of a previous frame, each pixel datum comprising a plurality of 8-bit grayscale values, the first memory storing the 8-bit grayscale values of the pixel data of the current frame and outputting the most significant 5 bits of grayscale values from the 8-bit grayscale values of the pixel data of the previous frame;

a second memory for storing driving values corresponding to an odd part of the most significant 5 bits of grayscale values from the 8-bit grayscale values of the pixel data of the current frame where the odd part is smaller than 5, and the most significant 5 bits of grayscale values from the 8 bits of grayscale values of the pixel data of the previous frame;

a third memory for storing driving values corresponding to an even part of the most significant 5 bits of grayscale values from the 8-bit grayscale values of each pixel datum of the current frame where the even part is smaller than 5, and the most significant 5 bits of grayscale values from the 8 bits of grayscale values of each pixel datum of the previous frame;

an operation processing unit for reading the least significant 3 bits of grayscale values W from the 8-bit grayscale values of a pixel data of the current frame, a first driving value X stored in the second memory and a second driving value Y stored in the third memory, and processing a calculation to obtain a third driving value Z between X and Y; and a logic judging unit for reading a pixel data of the current frame and the same pixel data of the previous frame, and judging if a difference of the 8-bit grayscale values between a pixel data of the current frame and the same pixel data of the previous frame is less than a specified value, wherein the third driving value Z is outputted as a driving value for the current frame when the difference is larger than the specified value.

9. The driving system for liquid crystal display as set forth in claim 8, wherein each pixel datum comprises grayscale values of R, G and B.

10. The driving system for liquid crystal display as set forth in claim 8, wherein Z satisfies an equation: $Z=(1/2^B)\cdot[X\cdot(2^B-W)+Y\cdot W]$.

11. A driving method for liquid crystal display, comprising:

storing c-bit grayscale values of pixel data of a current frame, "c" is a positive integer;

reading the most significant "A" bits of grayscale values from the c-bit grayscale values of pixel data of the current frame and of a stored previous frame, "A" is a positive integer less than "c";

judging a difference between the c-bit grayscale values of pixel data of the current frame and of the previous frame to see whether the difference is less than a specified value;

finding out a first driving value X by looking up a first mapping table, and finding out a second driving value Y by looking up a second mapping table; and reading the least significant "B" bits of grayscale value W from the c-bit grayscale values of pixel data of the current frame, the first driving value X, and the second driving value Y; and processing a calculation to obtain a third driving value Z between X and Y, "B" is a positive integer, wherein Z satisfies an equation $Z=(1/2^B)\cdot[X\cdot(2^B-W)+Y\cdot W]$;

wherein driving values corresponding to pixel data of the current frame are outputted as real driving values for the current frame when the difference is less than the specified value; the third driving value Z are outputted as driving values for the current frame when the difference is larger than the specified value.

12. The driving method for a liquid crystal display as set forth in claim 11, wherein "B" satisfies an equation "B"="c"−"A".

13. The driving method for a liquid crystal display as set forth in claim 11, wherein the first mapping table comprising driving values in correspondence with half part of the most significant "A" bits of grayscale values from the c-bit grayscale values of pixel data of the current frame and the most significant "A" bits of grayscale values from the c-bit grayscale values of pixel data of the previous frame; and the second mapping table comprising driving values in correspondence with the other half part of the most significant "A" bits of grayscale values from the c-bit grayscale values of pixel data of the current frame and the most significant "A" bits of grayscale values from the c-bit grayscale values of pixel data of the previous frame.

14. The driving method for a liquid crystal display as set forth in claim 11, wherein each pixel datum comprises grayscale values of R, G and B.

15. The driving method for a liquid crystal display as set forth in claim 11, wherein "c" is 8.

16. The driving method for a liquid crystal display as set forth in claim 11, wherein "A" is 5 and "B" is 3.

* * * * *